US012163415B2

(12) United States Patent
Eslinger

(10) Patent No.: US 12,163,415 B2
(45) **Date of Patent: *Dec. 10, 2024**

(54) STATE ESTIMATION AND RUN LIFE PREDICTION FOR PUMPING SYSTEM

(71) Applicant: Sensia LLC, Houston, TX (US)

(72) Inventor: David Milton Eslinger, Collinsville, OK (US)

(73) Assignee: SENSIA LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/001,274

(22) Filed: Aug. 24, 2020

(65) Prior Publication Data

US 2020/0386091 A1 Dec. 10, 2020

Related U.S. Application Data

(63) Continuation of application No. 15/301,618, filed as application No. PCT/US2015/023606 on Mar. 31, 2015, now Pat. No. 10,753,192.

(Continued)

(51) Int. Cl.
*E21B 47/008* (2012.01)
*E21B 43/12* (2006.01)

(Continued)

(52) U.S. Cl.
CPC ..... *E21B 47/008* (2020.05); *E21B 43/12* (2013.01); *E21B 43/128* (2013.01); *F04D 13/10* (2013.01);

(Continued)

(58) Field of Classification Search
CPC ..... E21B 47/008
See application file for complete search history.

(56) References Cited

U.S. PATENT DOCUMENTS 2,270,666 A * 1/1942 Arutunoff ..... F04D 13/10 417/414
2,315,917 A * 4/1943 Arutunoff ..... H02K 5/132 310/87

(Continued)

FOREIGN PATENT DOCUMENTS

EP 0 997 608 A2 5/2000
EP 1 549 942 B1 7/2008

(Continued)

OTHER PUBLICATIONS

BR Office Action for Brazilian Appl. Ser. No. BR 112016022984-3, dated Jun. 21, 2020, 6 pages (English Translation).

(Continued)

*Primary Examiner* — Blake Michener
(74) *Attorney, Agent, or Firm* — Foley & Lardner LLP

(57) ABSTRACT

A method for evaluating operation of an electric submersible pumping (ESP) system is shown. The method includes receiving first sensor data from sensors monitoring operation of the ESP system. The method further includes using a physical model of the electric submersible pumping system to determine second sensor data. The method further includes processing the first sensor data and the second sensor data to determine an first system state as a function of operating time. The method further includes generating a degradation model and applying the degradation model to the first sensor data and the second sensor data to generate a time prediction. The method further includes adjusting operation of the electric submersible pumping system in response to the predictor of the time to failure of the components.

20 Claims, 4 Drawing Sheets

Related U.S. Application Data

(60) Provisional application No. 61/974,786, filed on Apr. 3, 2014.

(51) Int. Cl.
*F04D 13/10* (2006.01)
*F04D 15/00* (2006.01)

(52) U.S. Cl.
CPC ..... *F04D 15/0066* (2013.01); *F04D 15/0077* (2013.01); *F04D 15/0088* (2013.01)

(56) References Cited

U.S. PATENT DOCUMENTS 4,854,164 A 8/1989 Rhoads
5,035,581 A 7/1991 McGuire et al.
5,064,349 A 11/1991 Turner et al.
5,210,704 A 5/1993 Husseiny
5,222,867 A 6/1993 Walker et al.
5,252,031 A 10/1993 Gibbs
5,732,776 A 3/1998 Tubel et al.
5,735,346 A 4/1998 Brewer
5,745,200 A 4/1998 Kikuchi et al.
5,868,029 A 2/1999 Paine
5,941,305 A 8/1999 Thrasher et al.
6,041,856 A 3/2000 Thrasher et al.
6,085,836 A 7/2000 Burris et al.
6,119,781 A 9/2000 Lemetayer et al.
6,155,347 A 12/2000 Mills
6,167,965 B1 * 1/2001 Bearden ..... E21B 47/0175 417/18
6,178,393 B1 * 1/2001 Irvin ..... F04D 15/0066 700/282
6,254,353 B1 * 7/2001 Polo ..... F04D 15/0077 318/280
6,310,559 B1 10/2001 Laborde et al.
6,585,041 B2 7/2003 Crossley
6,587,037 B1 7/2003 Besser et al.
6,834,256 B2 12/2004 House et al.
6,947,870 B2 9/2005 Zhu et al.
7,044,215 B2 5/2006 Boyles
7,114,557 B2 10/2006 Cudmore et al.
7,218,997 B2 5/2007 Bassett
7,248,178 B2 7/2007 Layton
7,558,699 B2 7/2009 Beck et al.
7,658,227 B2 2/2010 Fox et al.
7,686,074 B2 3/2010 McCoy et al.
7,762,339 B2 7/2010 Bevan et al.
7,861,777 B2 1/2011 Sheth et al.
7,869,978 B2 1/2011 Anderson et al.
8,016,027 B2 9/2011 Boyles
8,028,753 B2 10/2011 Shaw et al.
8,036,838 B2 10/2011 Parkinson
8,082,217 B2 12/2011 Crossley et al.
8,092,190 B2 1/2012 Leuthen et al.
8,141,646 B2 3/2012 Allen et al.
8,204,697 B2 6/2012 Garvey et al.
8,261,819 B1 9/2012 Gibbs et al.
8,267,171 B2 9/2012 Atherton
8,287,246 B2 10/2012 Plitt et al.
8,314,583 B2 11/2012 Yohanan et al.
8,384,318 B2 2/2013 Beck et al.
8,454,330 B2 6/2013 Lyngholm
8,560,268 B2 10/2013 Smithson
8,571,798 B2 10/2013 Atherton
8,776,617 B2 * 7/2014 Durham ..... F04B 51/00 73/862.08
8,784,068 B2 7/2014 Thompson et al.
9,074,459 B2 7/2015 Mitchell et al.
9,441,633 B2 * 9/2016 Sheth ..... E21B 43/126
9,720,424 B2 8/2017 Ige et al.
9,777,723 B2 * 10/2017 Wiegman ..... F04B 49/065
10,087,741 B2 * 10/2018 Chen ..... E21B 49/08
10,113,549 B2 * 10/2018 Coste ..... F04D 15/0077
2002/0130783 A1 * 9/2002 Hogan ..... F04D 15/0088 340/853.1
2002/0152807 A1 * 10/2002 Sabini ..... F04D 29/669 73/168
2003/0015320 A1 * 1/2003 Crossley ..... E21B 47/008 166/250.15
2003/0202188 A1 * 10/2003 Discenzso ..... F16C 19/52 356/477
2005/0043921 A1 * 2/2005 Zhu ..... G05B 13/027 702/183
2005/0143956 A1 * 6/2005 Long ..... F04D 15/0088 702/184
2005/0173114 A1 * 8/2005 Cudmore ..... E21B 47/008 166/250.15
2005/0205249 A1 9/2005 Boyles
2007/0252717 A1 * 11/2007 Fielder ..... F04D 13/10 417/63
2008/0236821 A1 10/2008 Fielder
2008/0270328 A1 10/2008 Lafferty et al.
2009/0032240 A1 2/2009 Boyles
2009/0044938 A1 * 2/2009 Crossley ..... G05B 23/0243 166/250.15
2009/0082977 A1 3/2009 Parkinson
2010/0169030 A1 * 7/2010 Parlos ..... H02P 29/0241 702/58
2010/0191484 A1 7/2010 Schoonover
2011/0071966 A1 3/2011 Holley et al.
2012/0025997 A1 * 2/2012 Liu ..... E21B 47/009 340/679
2012/0027630 A1 * 2/2012 Forsberg ..... F04D 15/0209 417/423.3
2012/0084055 A1 4/2012 Smithson
2012/0191633 A1 * 7/2012 Liu ..... E21B 47/008 706/12
2012/0325456 A1 12/2012 Hill
2013/0080117 A1 * 3/2013 Liu ..... E21B 44/00 702/183
2013/0133881 A1 5/2013 Boyles et al.
2013/0151156 A1 * 6/2013 Noui-Mehidi ..... G01V 3/06 702/7
2013/0175030 A1 * 7/2013 Ige ..... G05B 15/02 166/250.15
2013/0199775 A1 8/2013 Burleigh
2013/0211811 A1 8/2013 Zhu
2013/0278183 A1 * 10/2013 Liang ..... H02P 27/06 318/400.2
2014/0034390 A1 2/2014 Mitchell et al.
2014/0244552 A1 * 8/2014 Liu ..... G06N 20/00 706/12
2014/0301869 A1 * 10/2014 Durham ..... F04D 15/0088 417/63
2015/0095100 A1 * 4/2015 Vittal ..... G05B 23/0213 700/282
2015/0322765 A1 * 11/2015 Clem ..... E21B 47/008 166/250.01
2016/0281479 A1 * 9/2016 Rendusara ..... E21B 43/128
2017/0089192 A1 * 3/2017 Rendusara ..... F04D 13/10
2017/0096889 A1 * 4/2017 Blanckaert ..... E21B 43/128
2018/0066503 A1 3/2018 Vittal et al.

FOREIGN PATENT DOCUMENTS

EP 2 039 935 A2 3/2009
WO WO-99/15756 A2 4/1999
WO WO-2004/114510 A3 12/2004
WO WO-2009/023659 A1 2/2009
WO WO-2010/075227 A3 7/2010
WO WO-2011/046747 A3 4/2011
WO WO-2012/082081 A2 6/2012
WO WO-2012/135330 A3 10/2012
WO WO-2012/151488 A1 11/2012
WO WO-2013/022424 A1 2/2013

(56) References Cited

FOREIGN PATENT DOCUMENTS

| | | |
|---|---|---|
| WO | WO-2013/022646 A1 | 2/2013 |
| WO | WO-2013/126606 A1 | 8/2013 |

OTHER PUBLICATIONS

International Search Report and Written Opinion on International Appl. Ser. No. PCT/US2015/023606 dated Jul. 13, 2015, (11 pages).
Schlumberger Oilfield Glossary entry for "adjustable choke", accessed Jun. 21, 2018 via www.glossary.oilfield.slb.com.
United Kingdom Examination Report for Appl. Ser. No. GB 1616711.6, dated Sep. 16, 2020, (2 pages).
United Kingdom Examination Report for Application No. GB 1616711.6 mailing date Mar. 31, 2020, 2 pages.
BR Office Action on BR Appl. Ser. No. 112016022984-3 Feb. 1, 2022 (4 pages).

* cited by examiner

STATE ESTIMATION AND RUN LIFE PREDICTION FOR PUMPING SYSTEM

CROSS-REFERENCE TO RELATED APPLICATIONS

This application is a continuation application of U.S. application Ser. No. 15/301,618 filed Oct. 3, 2016, which is a U.S. National Stage Application of International Application No. PCT/US2015/023606, filed Mar. 31, 2015, which claims the benefit of and priority to U.S. Provisional Application No. 61/974,786, filed Apr. 3, 2014, the entire disclosures of which are incorporated by reference herein in their entireties.

BACKGROUND

Electric submersible pumping systems are used in a variety of pumping applications, including downhole well applications. For example, electric submersible pumping systems can be used to pump hydrocarbon production fluids to a surface location or to inject fluids into a formation surrounding a wellbore. Repair or replacement of an electric submersible pumping system located downhole in a wellbore is expensive and time-consuming. However, predicting run life and/or failure of the electric submersible pumping system is difficult and this limits an operator's ability to make corrective actions that could extend the run life of the pumping system.

SUMMARY

In general, a technique is provided to help predict the run life of a pumping system, e.g. an electric submersible pumping system (ESP). Knowledge regarding the predicted run life and factors affecting that predicted run life enables selection of corrective actions. The corrective actions may involve adjustment of operational parameters related to the pumping system so as to prolong the first run life of the pumping system. The technique utilizes an algorithm which combines various models, e.g. physical models and degradation models, to provide various failure/run life predictions. The various models utilize a variety of sensor data which may include first sensor data and second sensor data to both evaluate the state of the pumping system and the predicted run life of the pumping system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a technique which improves the ability to predict run life of a pumping system, e.g. an electric submersible pumping system. Depending on the application, the prediction of run life may be based on evaluation of the overall electric submersible pumping system, selected components of the electric submersible pumping system, or both the overall system and selected components. Knowledge regarding the predicted run life and factors affecting that predicted run life enables selection of corrective actions.

The corrective actions selected to prolong the run life of a pumping system, e.g. an electric submersible pumping system, can vary substantially depending on the specifics of, for example, an environmental change, an indication of component failure, goals of a production or injection operation, and/or other system or operational considerations. For example, corrective actions may involve adjustment of operational parameters regarding the electric submersible pumping system, including slowing the pumping rate, adjusting a choke (94), or temporarily stopping the pumping system.

The technique for predicting failure/run life of the pumping system utilizes an algorithm which combines various models, e.g. physical models and degradation models, to provide failure/run life predictions. The models may utilize a variety of sensor data including first sensor data and second sensor data to both evaluate the state of the pumping system and the predicted run life of the pumping system. The overall algorithm may be adjusted to accommodate specific system considerations, environmental considerations, operational considerations, and/or other application-specific considerations.

Figure 1:
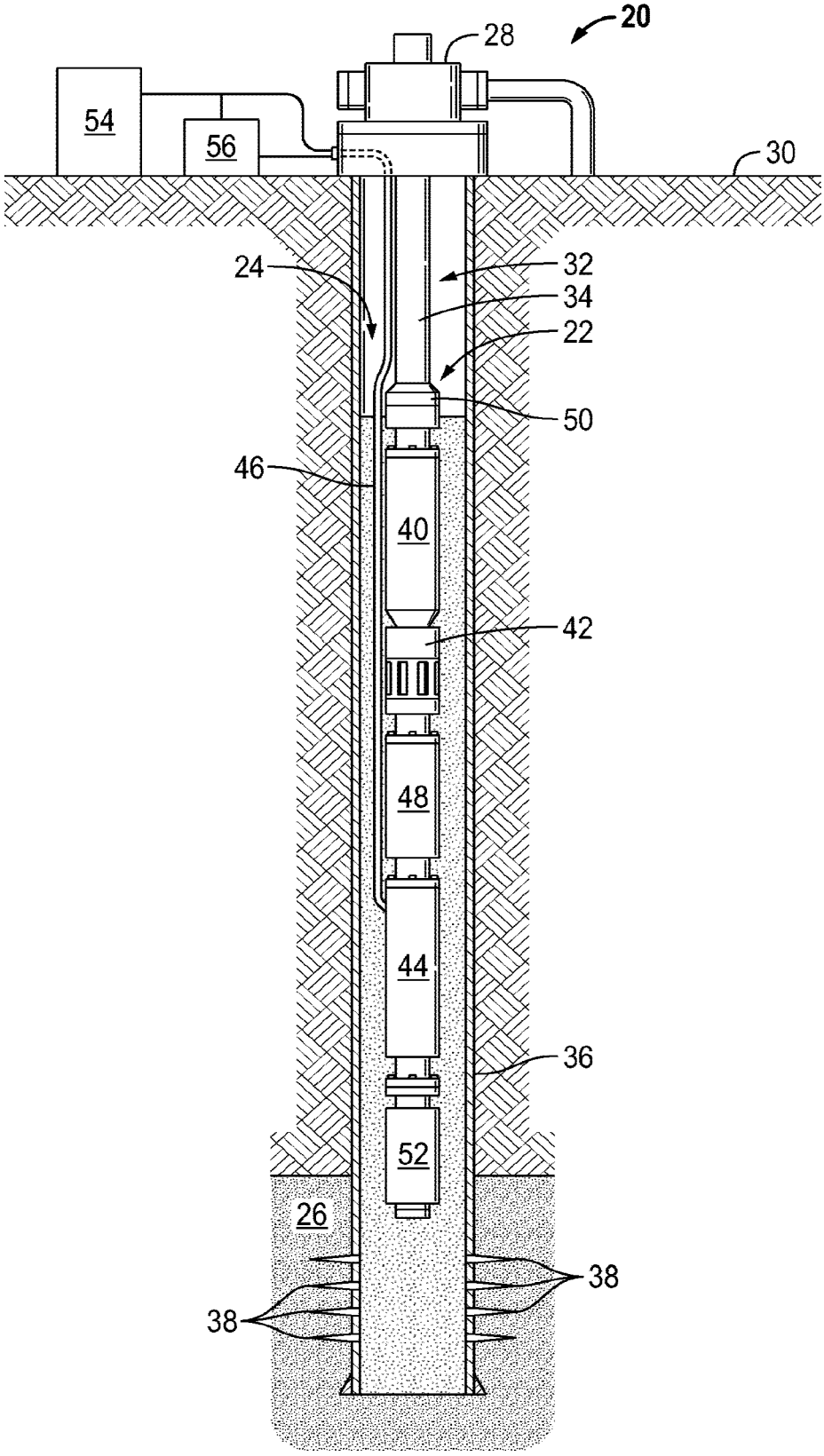
FIG. 1 is a schematic illustration of a well system comprising an example of a pumping system, according to an embodiment of the disclosure.

Referring generally to FIG. 1, an example of a well system 20 comprising a pumping system 22, such as an electric submersible pumping system or other downhole pumping system, is illustrated. In this embodiment, pumping system 22 is disposed in a wellbore 24 drilled or otherwise formed in a geological formation 26. The pumping system 22 is located below well equipment 28, e.g. a wellhead, which may be disposed at a seabed or a surface 30 of the earth. The pumping system 22 may be deployed in a variety of wellbores 24, including vertical wellbores or deviated, e.g. horizontal, wellbores. In the example illustrated, pumping system 22 is suspended by a deployment system 32, such as production tubing, coiled tubing, or other deployment system. In some applications, deployment system 32 comprises a tubing 34 through which well fluid is produced to wellhead 28.

As illustrated, wellbore 24 is lined with a wellbore casing 36 having perforations 38 through which fluid flows between formation 26 and wellbore 24. For example, a hydrocarbon-based fluid may flow from formation 26 through perforations 38 and into wellbore 24 adjacent pumping system 22. Upon entering wellbore 24, pumping system 22 is able to produce the fluid upwardly through tubing 34 to wellhead 28 and on to a desired collection point.

Although pumping system 22 may comprise a wide variety of components, the example in FIG. 1 is illustrated as an electric submersible pumping system 22 having a submersible pump 40, a pump intake 42, and a submersible electric motor 44 that powers submersible pump 40. Submersible pump 40 may comprise a single pump or multiple pumps coupled directly together or disposed at separate locations along the submersible pumping system string. Depending on the application, various numbers of submersible pumps 40, submersible electric motors 44, other submersible components, or even additional pumping systems 22 may be combined for a given downhole pumping application.

In the embodiment illustrated, submersible electric motor 44 receives electrical power via a power cable 46 and is pressure balanced and protected from deleterious wellbore fluid by a motor protector 48. In addition, pumping system 22 may comprise other components including a connector 50 for connecting the components to deployment system 32. Another illustrated component is a sensor unit 52 utilized in sensing a variety of wellbore parameters. It should be noted, however, that sensor unit 52 may comprise a variety of sensors and sensor systems deployed along electric submersible pumping system 22, along casing 36, or along other regions of wellbore 24 to obtain data for determining one or more desired parameters, as described more fully below. Furthermore, a variety of sensor systems 52 may comprise sensors located at surface 30 to obtain desired data helpful in the process of determining measured parameters related to prediction of failures/run life of electric submersible pumping system 22 or specific components of pumping system 22.

Data from the sensors of sensor system 52 may be transmitted to a processing system 54, e.g. a computer-based control system, which may be located at surface 30 or at other suitable locations proximate or away from wellbore 24. The processing system 54 may be used to process data from the sensors and/or other data according to a desired overall algorithm which facilitates prediction of system run life. In some applications, the processing system 54 is in the form of a computer-based control system which may be used to control, for example, a surface power system 56 which is operated to supply electrical power to pumping system 22 via power cable 46. Surface power system 56 may be controlled in a manner which enables control over operation of submersible electric motor 44, e.g. control over motor speed, and thus control over the pumping rate or other aspects of pumping system 22 operation.

Figure 2:
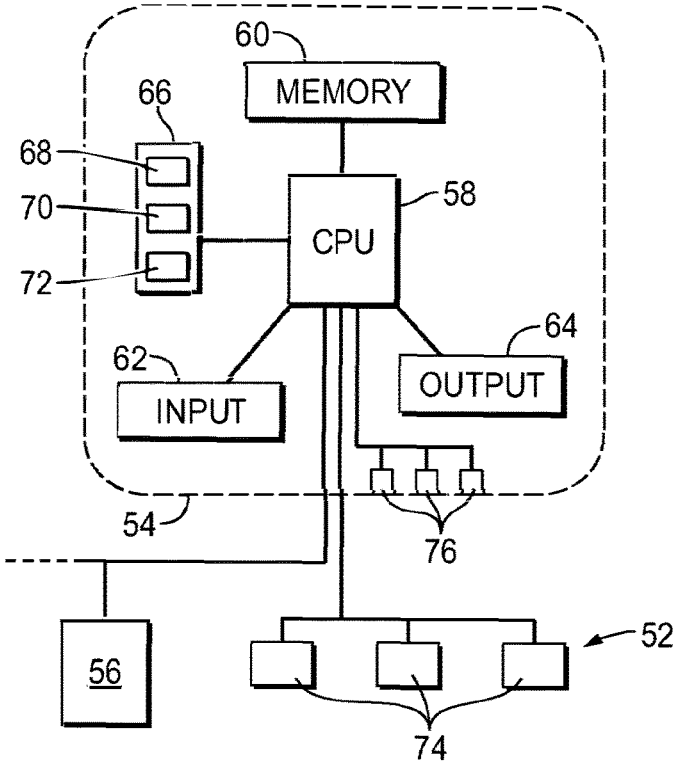
FIG. 2 is a schematic illustration of a processing system implementing an embodiment of an algorithm for predicting run life of a pumping system, according to an embodiment of the disclosure.

Referring generally to FIG. 2, an example of processing system 54 is illustrated schematically. In this embodiment, processing system 54 may be a computer-based system having a central processing unit (CPU) 58. CPU 58 is operatively coupled to a memory 60, as well as an input device 62 and an output device 64. Input device 62 may comprise a variety of devices, such as a keyboard, mouse, voice-recognition unit, touchscreen, other input devices, or combinations of such devices. Output device 64 may comprise a visual and/or audio output device, such as a monitor having a graphical user interface. Additionally, the processing may be done on a single device or multiple devices at the well location, away from the well location, or with some devices located at the well and other devices located remotely.

In the illustrated example, CPU 58 may be used to process data according to an overall algorithm 66. As discussed in greater detail below, overall algorithm 66 may utilize a variety of models, such as physical models 68, degradation models 70, and optimizer models 72, e.g. optimizer engines, to evaluate data and predict run life/failure with respect to electric submersible pumping system 22. Additionally, processing system 54 may be used to process data received from first sensors 74 forming part of sensor system 52. Processing system 54 also may be used to process second sensor data from second sensors 76. By way of example, the data from first sensors 74 and second sensors 76 may be processed on CPU 58 according to desired models or other processing techniques embodied in overall algorithm 66.

As illustrated, processing system 54 also may be used to control operation of the pumping system by, for example, controlling surface power system 56. This allows processing system 54 to be used as a control system for adjusting operation of the electric submersible pumping system 22 in response to predictions of run life or component failure. In some applications, the control aspects of processing system 54 may be automated so that automatic adjustments to the operation of pumping system 22 may be implemented in response to run life/component failure predictions resulting from data processed according to overall algorithm 66.

Figure 3:
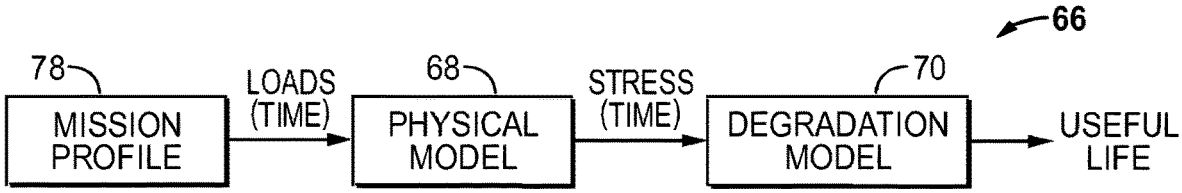
FIG. 3 is an illustration of an example of an algorithm for predicting useful life of an overall pumping system or component of the pumping system prior to installation, according to an embodiment of the disclosure.

Referring generally to FIG. 3, an example of overall algorithm 66 is illustrated as one technique for evaluating data related to electric submersible pumping system 22 in a manner facilitating run life prediction. In this example, a mission profile 78 is used in cooperation with physical model 68 which, in turn, is used in cooperation with degradation model 70 to predict the useful life of at least one component of electric submersible pumping system 22. In this embodiment, the prediction is established before installation of electric submersible pumping system 22 into wellbore 24 and is based on the anticipated mission profile 78 to be employed during future operation of the electric submersible pumping system 22.

According to this method, mission profile 78 provides inputs to processing system 54 as a function of run time. For example, mission profile 78 may input "loads" such as pressure rise, vibration, stop/start of pumping system 22, and/or other inputs as a function of time. These loads are then input to physical model 68 of the particular electric submersible pumping system 22 or of a specific component of the electric submersible pumping system 22. Physical model 68 is then used to predict "stresses" or system outputs as a function of run time. By way of example, such system outputs may comprise shaft cycle stress, pump front seal leakage velocity, motor winding temperature, and/or other system outputs. The system outputs are then input to degradation model 70.

Degradation model 70 predicts the useful life of the overall electric submersible pumping system 22 or a component of the electric submersible pumping system 22. Degradation model 70 is configured to process the data from first sensors 74 according to, for example, shaft fatigue analysis, stage front seal erosion models, motor insulation temperature degradation data analysis, and/or other suitable data analysis techniques selected to determine a predicted life of a given component or of the overall electric submersible pumping system 22.

Depending on the application, physical model 68 may include, for example, data related to component mechanical stress, thermal stress, vibration, wear, and/or leakage. Various degradation models 70 may be selected to process the data from physical model 68 via processing system 54. For example, degradation model or models 70 may further comprise wear models, empirical test data, and/or fatigue models to improve prediction of the component or system life based on data from physical model 68.

Figure 4:
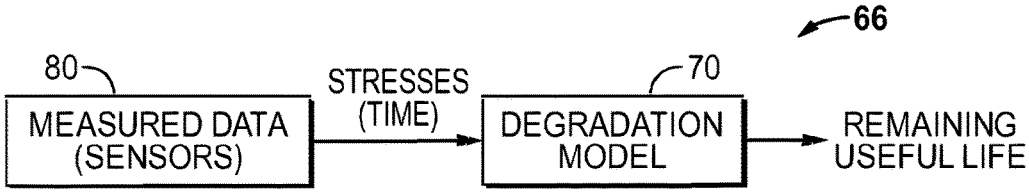
FIG. 4 is an illustration of an example of an algorithm for predicting useful life of an overall pumping system or component of the pumping system in which the algorithm utilizes data from first sensors, according to an embodiment of the disclosure.

Referring generally to FIG. 4, another example of an overall algorithm 66 is illustrated as one technique for evaluating data related to electric submersible pumping system 22 in a manner facilitating run life prediction. The example illustrated in FIG. 4 may be used independently or combined with other prediction techniques, such as the prediction technique described with reference to FIG. 3. In the example illustrated in FIG. 4, measured data 80 is obtained and provided to degradation model 70. Measured data 80 is obtained from sensors, such as first sensors 74, which monitor at least one component of electric submersible pumping system 22 during operation. This data is provided to component/system degradation model 70 so that the data may be appropriately processed via processing system 54 to predict a remaining useful life of the component (or overall pumping system 22) during operation of the electric submersible pumping system 22.

In this example, "stresses" are measured in real-time by first sensors 74 which may be disposed along the electric submersible pumping system 22 and/or at other suitable locations. For example, first sensors 74 may be located along pumping system 22 to monitor parameters related to an individual component or to combinations of components. In some applications, first sensors 74 may be located to monitor the motor winding temperature of submersible electric motor 44. The measured motor winding temperatures are then used in the corresponding degradation model 70 to predict in real-time the remaining useful life of the pumping string component, e.g. submersible electric motor 44. In this specific example, degradation model 70 may be programmed or otherwise configured to predict the remaining useful life of the motor magnet wire based on the motor winding temperatures according to predetermined relationships between useful life and temperatures.

However, the use of first sensor data in combination with degradation model 70 may be applied to a variety of components according to this embodiment of overall algorithm 66. For example, first sensors 74 may be used to monitor specific motor temperatures and this data may be provided to degradation model 70 to predict the aging of a motor lead wire, a magnet wire, and/or a coil retention system. According to another example, first sensors 74 may be positioned to monitor water ingress into, for example, motor protector 48 and submersible electric motor 44. This data is then used by degradation model 70 to predict when the water front will reach the submersible electric motor 44 in a manner which corrupts operation of the submersible electric motor 44.

In another example, the first sensors 74 are used to monitor temperatures along the well system 20, e.g. along electric submersible pumping system 22. This temperature data is then used by degradation model 70 to predict aging and stress relaxation (sealability) of elastomeric seals (90) along the electric submersible pumping system 22. The first sensors 74 also may be positioned at appropriate locations along the electric submersible pumping system 22 to measure vibration. The vibration data is then analyzed according to degradation model 70 to predict failure of bearings (92) within the electric submersible pumping system 22.

A variety of sensors may be used to collect data related to various aspects of pumping system operation, and selected degradation models 70 may be used for analysis of that data on processing system 54. In many applications, the output from degradation model 70 regarding remaining useful life of a given component can be used to make appropriate adjustments to operation of electric submersible pumping system 22. In some applications, the appropriate adjustments may be performed automatically via processing/control system 54.

Figure 5:
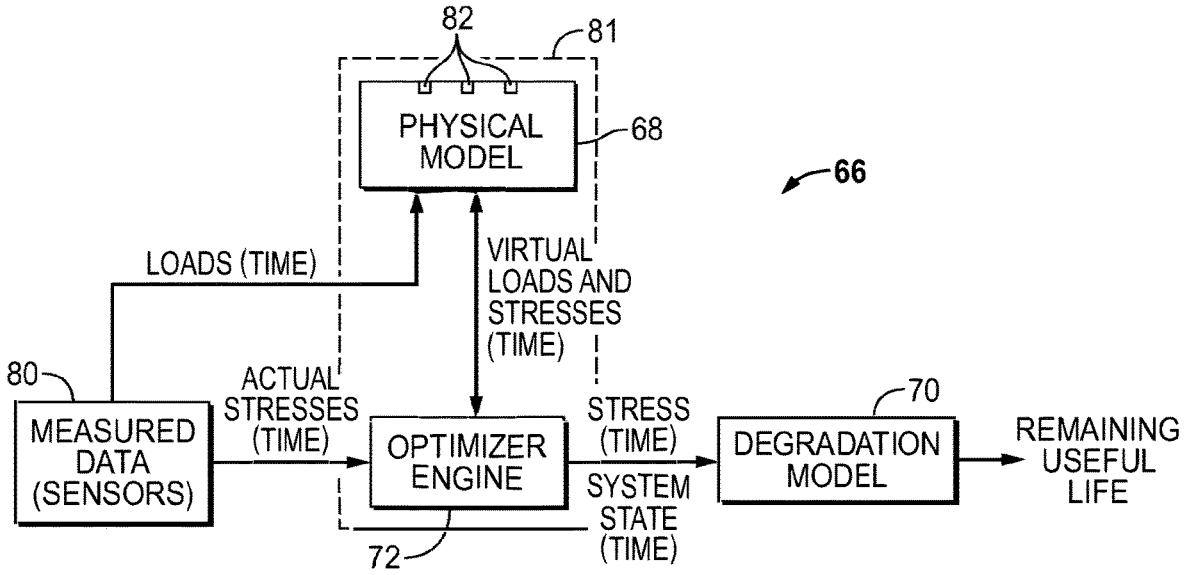
FIG. 5 is an illustration of an example of an algorithm for predicting useful life of an overall pumping system or component of the pumping system in which the algorithm utilizes data from first sensors and second sensors, according to an embodiment of the disclosure.

Referring generally to FIG. 5, another example of an overall algorithm 66 is illustrated as one technique for evaluating data related to electric submersible pumping system 22 in a manner facilitating run life prediction. The example illustrated in FIG. 5 may be used independently or combined with other prediction techniques, such as the prediction techniques described above. In the example illustrated in FIG. 5, measured data 80 is obtained from first sensors 74 employed to monitor the electric submersible pumping system 22 during operation. In combination with measured data 80, a physical model 68 of the electric submersible pumping system 22 and a component degradation model 70 are used to predict remaining run life of pumping system components or the overall pumping system 22.

According to this method, "loads" measured in real-time by first sensors 74 positioned along electric submersible pumping system 22 are used by the physical model or models 68 to predict "second stresses" on the electric submersible pumping system 22 or components of the pumping system 22 in real-time. Furthermore, first stresses measured by first sensors 74 may be used together with the physical model(s) 68 and optimizer engine 72 to determine a set of measured system loads and second system loads. The second system loads are system loads not measured by first sensors 74 but which provide a desired correlation between first stresses measured by first sensors 74 and the same second stresses predicted by the physical model(s) 68. The set of second loads and measured loads as well as the set of second stresses and measured stresses determined according to this method provide an improved description of the "system state" of the pumping system 22 as a function of operating time. The set of first measured stresses and second stresses are then used by degradation model 70 to predict a remaining useful life of the pumping system components or the overall electric submersible pumping system 22.

In various applications, a "system identification" process may be employed for determining the second loads, as represented by module 81 in FIG. 5. The system identification process/module 81 may encompass, for example, physical models 68 and optimizer engine 72. System identification refers to a process utilizing physical models which may range from "black box" processes in which no physical model is employed to "white box" processes in which a complete physical model is known and employed. In system identification processes, the terminology "grey box" also is sometimes used to represent semi-physical modeling. The black, grey, and white box aspects of the system identification process are represented by reference numeral 82 in FIG. 5.

Generally, the system identification process employs statistical methods for constructing mathematical models of dynamic systems from measured data, e.g. the data obtained from first sensors 74. The system identification process also may comprise generating informative data used to fit such models and to facilitate model reduction. By way of example, such a system identification process may utilize measurements of electric submersible pumping system behavior and/or external influences on the pumping system 22 based on data obtained from first sensors 74.

The data is then used to determine a mathematical relationship between the data and a state or occurrence, e.g. a second load or even a run life or component failure. This type of "system identification" approach enables determination of such mathematical relationships without necessarily obtaining details on what firstly occurs within the system of interest, e.g. within the electric submersible pumping system 22. White box methodologies may be used when activities within the pumping system 22 and their relationship to run life are known, while grey box methodologies may be used when the activities and/or relationships are partially understood. Black box methodologies may comprise system identification algorithms and may be employed when no prior model for understanding the activities/relationships is known. A variety of system identification techniques are available and may be used to establish second loads and/or to develop failure/run life predictions.

The use of such second stresses may be helpful in a variety of applications to predict remaining useful life. For example, the use of second motor temperature data from locations other than locations at which temperature data is measured by first sensors 74 can be useful in predicting the aging of, for example, motor lead wire, magnet wire, and coil retention systems. Similarly, second motor temperature data from locations other than locations monitored by first sensors 74 can be useful in predicting aging and stress relaxation (sealability) of elastomeric seals (90) in the electric submersible pumping system 22. Additionally, the use of second water front data can be used to effectively predict when a water front will reach the submersible electric motor 44.

In various applications, second bearing data, e.g. bearing contact stress, lubricant film thickness, and/or vibration can be used to predict the remaining life of pumping system bearings (92). Similarly, second pump thrust washer loads may be used to predict washer life. Second wear data, such as second pump erosive and abrasive wear data, can be used to predict pump stage bearing life and pump stage performance degradation. Additionally, second torque shaft data may be used to predict torsional fatigue life damage and remaining fatigue life of various shafts in submersible pumping system 22. Second shaft seal data, e.g. contact stress, misalignment, vibration, may be used to predict the remaining life of various seals. Second data may be combined with first data in many ways to improve the ability to predict run life of a given component or system. As described above, the second data may be in the form of second stresses predicted by physical model(s) 68 and first data may be in the form of first stresses measured by first sensors 74.

Figure 6:
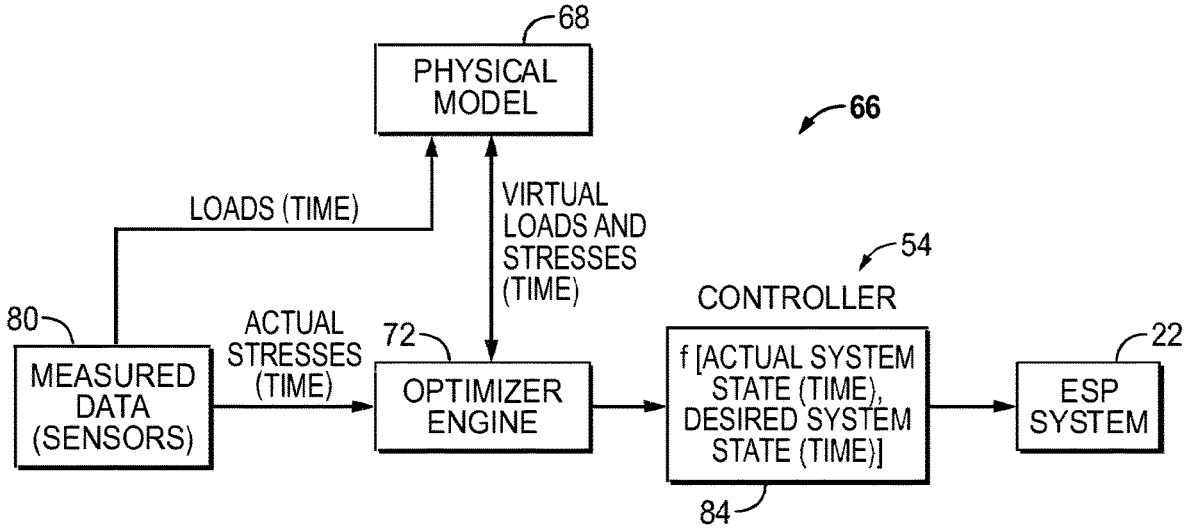
FIG. 6 is an illustration of a method of controlling a pumping system to achieve a desired system state based on data regarding an first system state as determined from first sensor data and second sensor data, according to an embodiment of the disclosure.
Figure 7:
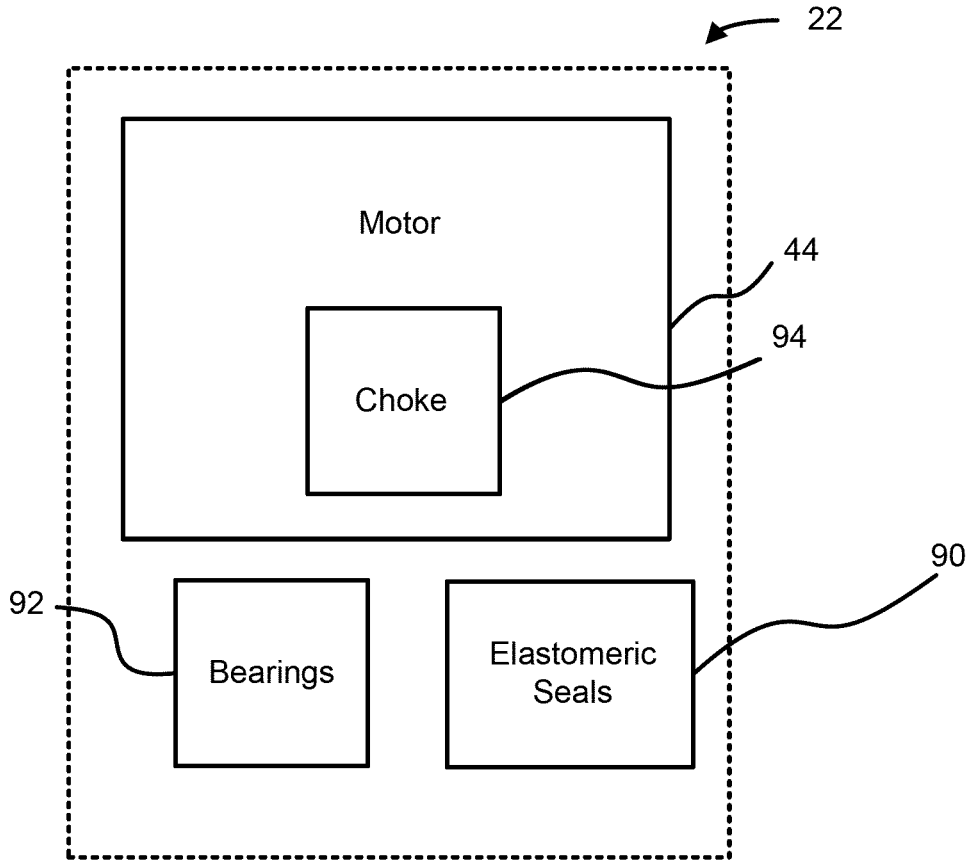
FIG. 7 is a schematic illustration of the pumping system of FIG. 1, according to an embodiment of the disclosure.

Referring generally to FIG. 6, another example of an overall algorithm 66 is illustrated as one technique for evaluating data related to electric submersible pumping system 22 in a manner facilitating run life prediction. The example illustrated in FIG. 6 may be used independently or combined with other prediction techniques, such as the prediction technique described above. In the example illustrated in FIG. 6, the "system state" of measured parameters and second parameters determined in real time may be obtained by a suitable method, such as the method described above with reference to FIG. 5.

The system state of measured parameters and second parameters is then used to identify events such as undesirable or non-optimum operating conditions. Examples of such conditions include gas-lock or other conditions which limit or prevent operation of the electric submersible pumping system 22. The system state of measured parameters and second parameters may be further used to control the electric submersible pumping system 22 by, for example, processor/control system 54. For example, the processor/control system 54 may utilize overall algorithm 66 to correct for conditions in the first system state to achieve a new desired system state 84, as illustrated in FIG. 6.

In this method, processor/control system 54 may be programmed according to a variety of models, algorithms or other techniques to automatically adjust operation of electric submersible pumping system 22 from a detected first system state to a desired system state. Depending on the application, the first system state may be determined by first sensor data, second sensor data, or a combination of first and second sensor data. In some applications, both first measured data and second data may be used as described above with respect to the embodiment illustrated in FIG. 5 to determine the first system state of operation with respect to electric submersible pumping system 22. Processor/control system 54 then automatically adjusts operation of electric submersible pumping system 22 according to the programmed algorithm, model, or other technique to move operation of the pumping system 22 to the desired system state. By way of example, processor/control system 54 may implement a change in motor speed and/or a change in a surface choke setting to adjust operation to the desired system state.

Depending on the application, the electric submersible pumping system 22 may have a variety of configurations and/or components. Additionally, overall algorithm 66 may be configured to sense and track a variety of first data and second data to monitor first states of specific components or of the overall pumping system 22. The first data and second data also may be related to various combinations of components and/or operational parameters. Additionally, the first data and second data may be processed by various techniques selected according to the type of data and the types of conditions being monitored. Based on predictions of run life determined from the first data and/or second data, various operational adjustments may be made manually or automatically to achieve desired system states so as to enhance longevity and/or other operational aspects related to the run life of the electric submersible pumping system.

Depending on the application, the methodologies described herein may be used to predict a run life of a pumping string, e.g. electric submersible pumping system, prior to installation based on an anticipated mission profile. The methodologies also may be used to predict remaining run life during operation of the pumping system. For example, the methodologies may be used to predict not simply imminent potential failure but also the time to failure throughout the life of the pumping system. In electric submersible pumping system applications, for example, the methodologies provide an operator or an automated control system with a substantial warning period prior to failure of the pumping system.

The methodologies described herein further facilitate improved responses to dynamic changes in, for example, an electric submersible pumping system string due to variable operating conditions. The improved responses enhance production and/or extend the run life of the electric submersible pumping system prior to failure. In various applications, second data is calculated according to a physical model for parameters other than those for which first measured data is available. The second data may be used alone or in combination with first measured data to enable a more comprehensive evaluation of potential pumping system failure modes. The more comprehensive evaluation enables improved control responses to mitigate those failure modes.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for operating an electric submersible pumping (ESP) system, the method comprising:

receiving first sensor data from sensors monitoring operation of the ESP system;

generating a model of the ESP system by using the first sensor data in a system identification process;

using the model of the ESP system to determine a virtual stress based on the first data;

predicting a remaining useful life of at least one component of the electric submersible pumping system by applying the first sensor data and the virtual stress as inputs to a degradation model configured to output the remaining useful life of the at least one component of the electric submersible pumping system, wherein the at least one component is at least one of one or more bearings or one or more elastomeric seals; and decreasing pumping rate of the electric submersible pumping system based on the remaining useful life of the at least one component to increase longevity of the component.

2. The method of claim 1, wherein:

receiving the first sensor data from sensors monitoring operation of the ESP system comprises receiving temperature data along a well system of the ESP system; and wherein the method comprises predicting, by the degradation model, aging and stress relaxation of the one or more elastomeric seals based on the temperature data.

3. The method of claim 1, wherein:

receiving the first sensor data from sensors monitoring operation of the ESP system comprises receiving vibration data along a well system of the ESP system; and the method comprises using, by the degradation model, the vibration data to predict failure of one or more bearings within the ESP system.

4. The method of claim 1, wherein:

receiving the first sensor data from sensors monitoring operation of the ESP system comprises receiving water ingress data of the ESP system; and wherein predicting amount of time to failure comprises predicting, by the degradation model based on the water ingress data, when a water front will reach a submersible electric motor of the ESP system such that water enters a motor protector and the submersible electric motor.

5. The method of claim 1, comprising adjusting operation of the ESP system based on the remaining useful life by adjusting the operation of the ESP system to a desired state to increase longevity of the ESP system.

6. The method of claim 1, comprising adjusting operation of the ESP system by adjusting operational parameters of the ESP system, the operational parameters comprising at least one of adjusting a choke in a motor of the ESP system or shutting down the ESP system.

7. The method of claim 1, wherein the model of the ESP system is a grey box model configured to output the virtual stress based on the first sensor data.

8. An electric submersible pumping system, comprising:

an electric submersible pump (ESP);

a computing device comprising one or more processors and memory storing instructions that, when executed by the one or more processors, cause the one or more processors to perform operations comprising:

obtaining sensor data from sensors monitoring operation of the ESP, wherein the sensor data comprises a motor temperature;

using a system identification process to:

determine a model of the ESP based on the sensor data; and determine loads or stresses on the ESP based on the sensor data;

providing a time-varying system state comprising the sensor data and the loads or stresses over a time period;

generating, by applying a degradation model to the time-varying system state, a remaining useful life of at least one component of the ESP as an output of the degradation model and based on the time-varying system state, wherein the at least one component comprises at least one of one or more bearings or one or more elastomeric seals; and adjusting operation of the ESP in response to the remaining useful life of the at least one component by decreasing a pumping rate of the ESP to increase longevity of the at least one component.

9. The system of claim 8, further comprising temperature sensors configured to be positioned along a well, wherein:

receiving the sensor data from the sensors monitoring operation of the ESP comprises receiving temperature data from the temperature sensors positioned along the well; and the operations comprise generating a stress prediction to predict aging and stress relaxation of the one or more elastomeric seals based on the temperature data.

10. The system of claim 8, further comprising a vibration sensor coupled to the ESP, wherein:

receiving the sensor data comprises receiving vibration data from the vibration sensor; and the operations comprise generating a vibration prediction to predict failure of the one or more bearings within the ESP system based on vibration data from the vibration sensor.

11. The system of claim 8, wherein:

receiving the sensor data comprises receiving water ingress data; and applying the degradation model comprises generating a water prediction to predict when a water front will reach a submersible electric motor of the ESP system in a manner which corrupts operation of the submersible electric motor.

12. The system of claim 8, wherein adjusting operation of the ESP comprises adjusting operation of the ESP to a desired state to increase longevity of the ESP.

13. The system of claim 8, wherein adjusting operation of the ESP further adjusting a choke in a motor of the ESP system.

14. The system of claim 8:

wherein the system identification process determines the model as a physical model using a grey box approach.

15. A system for operating an electric submersible pump (ESP), the system comprising:

a processor; and memory storing instructions that, when executed by the processor, cause the processor to perform operations of a system identification module and a degradation model module;

wherein the operations of the system identification module comprise:

receiving sensor data from one or more sensors configured to monitor operation of the ESP;

determining a model of the ESP based on the sensor data; and predicting, using the model and based on the sensor data, loads on the ESP over a period of time; and wherein the operations of the degradation model module comprise:

predicting a remaining useful life of one or more components within the ESP by applying the sensor data and the loads as inputs to a degradation model of the degradation model module that outputs the remaining useful life; and adjusting operation of the ESP in response to the remaining useful life of the one or more components by decreasing pumping rate of the ESP to increase longevity of the one or more components.

16. The system of claim 15, wherein receiving the sensor data comprises receiving at least one of temperature data from a motor temperature sensor at a motor location, pressure data, vibration data, or operating times of the ESP.

17. The system of claim 15, wherein the degradation model comprises a seal erosion model, and wherein the operations of the degradation model module further comprise analyzing seal erosion using the seal erosion model based on the sensor data and the loads.

18. The system of claim 15, wherein the operations of the system identification module further comprise:

predicting stresses on the ESP over the period of time; and providing second stresses to an optimizer engine; and providing a correlation between first stresses based on the first sensor data and the second stresses.

19. The system of claim 15, wherein adjusting operation of the ESP further comprises adjusting a choke in a motor of the ESP system or shutting down the ESP.

20. The system of claim 15 wherein generating the model of the ESP comprises fitting a physical model using at least one of a grey box or a white box approach.

* * * * *